US011077009B2

(12) United States Patent
Von Zitzewitz et al.

(10) Patent No.: US 11,077,009 B2
(45) Date of Patent: Aug. 3, 2021

(54) APPARATUS TO APPLY FORCES IN A THREE-DIMENSIONAL SPACE

(71) Applicant: ECOLE POLYTECHNIQUE FEDERALE DE LAUSANNE (EPFL), Lausanne (CH)

(72) Inventors: Joachim Von Zitzewitz, Lausanne (CH); Heike Vallery, Delfgauw (NL); Gregoire Courtine, Lausanne (CH)

(73) Assignee: ECOLE POLYTECHNIQUE FEDERALE DE LAUSANNE (EPFL), Lausanne (CH)

( * ) Notice: Subject to any disclaimer, the term of this patent is extended or adjusted under 35 U.S.C. 154(b) by 0 days.

(21) Appl. No.: 15/741,719

(22) PCT Filed: Jul. 1, 2016

(86) PCT No.: PCT/EP2016/065601
§ 371 (c)(1),
(2) Date: Jan. 3, 2018

(87) PCT Pub. No.: WO2017/005661
PCT Pub. Date: Jan. 12, 2017

(65) Prior Publication Data

US 2018/0193217 A1 Jul. 12, 2018

(30) Foreign Application Priority Data

Jul. 3, 2015 (EP) ..... 15175238

(51) Int. Cl.
*A61H 3/00* (2006.01)

(52) U.S. Cl.
CPC ..... *A61H 3/008* (2013.01); *A61H 2201/1481* (2013.01); *A61H 2201/165* (2013.01);
(Continued)

(58) Field of Classification Search
CPC ..... A61H 3/008; A61H 1/0218; A61H 2003/007; A61H 2201/1481;
(Continued)

(56) References Cited

U.S. PATENT DOCUMENTS 3,653,518 A * 4/1972 Polen ..... B66C 13/06 212/330
4,340,216 A * 7/1982 Murphy ..... A61H 3/008 105/150
(Continued)

FOREIGN PATENT DOCUMENTS

DE 3830429 A1 3/1990
DE 202007015508 U1 3/2008
(Continued)

OTHER PUBLICATIONS

Guyatt, G. et al., "The 6-minute walk: a new measure of exercise capacity in patients with chronic heart failure," Canadian Medical Association Journal, vol. 132, No. 8, Apr. 15, 1985, 5 pages.
(Continued)

*Primary Examiner* — Nyca T Nguyen
(74) *Attorney, Agent, or Firm* — McCoy Russell LLP

(57) ABSTRACT

The present invention relates to a robotic system useful to unload an object/person from its weight. The robotic system is useful in locomotor rehabilitation programs and allows the manipulation of forces in a three-dimensional space with far lower actuator requirements and a much higher precision than prior-art systems. The apparatus combines passive and active elements to minimize actuation requirements while still keeping inertia to a minimum and control precision to a maximum. It requires minimal actuators and at the same time has a low inertia.

24 Claims, 8 Drawing Sheets

(52) U.S. Cl.
CPC ..... *A61H 2201/1652* (2013.01); *A61H 2201/1659* (2013.01); *A61H 2201/5058* (2013.01); *A61H 2201/5061* (2013.01); *A61H 2201/5064* (2013.01); *A61H 2201/5092* (2013.01)

(58) Field of Classification Search
CPC ..... A61H 2201/5058; A61H 2201/165; A61H 2201/5064; A61H 2201/5092; A61H 2201/5061; A61H 2201/1659; A61H 2201/1652; A63B 7/00; B66D 1/26; B66D 1/36; B66D 1/48; B66D 1/50; B66D 1/60; B66D 1/68; B66D 1/7405; B66D 1/7426; B66D 3/08
USPC ..... 212/250
See application file for complete search history.

(56) References Cited

U.S. PATENT DOCUMENTS 4,356,902 A * 11/1982 Murphy ..... A61H 3/008 193/35 R
4,402,501 A * 9/1983 Lohman ..... A63B 3/00 482/42
4,410,175 A * 10/1983 Shamp ..... A63B 69/0064 114/215
4,574,789 A * 3/1986 Forster ..... A61H 1/0218 248/321
4,784,420 A * 11/1988 Makino ..... B66C 13/06 212/274
5,018,631 A * 5/1991 Reimer ..... B66C 13/06 212/250
5,337,908 A * 8/1994 Beck, Jr. ..... A61G 7/1015 104/126
5,421,783 A * 6/1995 Kockelman ..... A63B 5/16 472/135
5,441,465 A * 8/1995 Hefner ..... A63B 1/00 482/23
5,601,527 A * 2/1997 Selkowitz ..... A61H 3/008 254/413
5,626,540 A * 5/1997 Hall ..... A61H 1/0229 482/69
5,667,461 A * 9/1997 Hall ..... A61H 1/0229 472/15
5,788,606 A * 8/1998 Rich ..... A63B 69/0064 482/27
5,819,962 A * 10/1998 Okubo ..... B66C 13/06 212/275
6,139,475 A * 10/2000 Bessler ..... A61H 3/008 482/66
6,182,843 B1 * 2/2001 Tax ..... B66C 13/46 212/274
6,464,208 B1 * 10/2002 Smith ..... A61H 3/008 212/97
7,780,617 B2 * 8/2010 Tornatore ..... A61H 1/0229 602/34
7,861,872 B2 * 1/2011 Ng ..... B66C 1/104 212/316
8,100,815 B2 * 1/2012 Balaker ..... A63B 21/156 482/131
8,836,368 B2 * 9/2014 Afshar ..... H03K 19/17728 326/41
2003/0145759 A1 * 8/2003 Rodnunsky ..... B61B 7/00 104/180
2005/0239612 A1 * 10/2005 Keiser ..... A63B 21/0087 482/94
2006/0189453 A1 * 8/2006 Leblond ..... A62B 35/0087 482/69
2007/0004567 A1 * 1/2007 Shetty ..... A61H 3/008 482/69
2008/0287268 A1 * 11/2008 Hidler ..... A61H 3/008 482/69
2008/0318733 A1 * 12/2008 Osler-Weppenaar .... A63B 5/00 482/23
2009/0312165 A1 * 12/2009 Rempe ..... A63B 22/18 482/146
2010/0006737 A1 * 1/2010 Colombo ..... A61H 3/008 248/571
2011/0230808 A1 * 9/2011 Lisowski ..... A61H 1/0218 602/36
2011/0260126 A1 * 10/2011 Willis ..... B63B 27/08 254/283
2012/0018249 A1 * 1/2012 Mehr ..... A63B 69/0064 182/5
2012/0168397 A1 * 7/2012 Lim ..... B66C 13/063 212/273
2013/0116604 A1 * 5/2013 Morilla ..... A61G 7/1015 601/33
2013/0158444 A1 * 6/2013 Herr ..... A61H 1/0255 601/23
2013/0190143 A1 * 7/2013 Greenhill ..... A63B 21/0058 482/104
2014/0087922 A1 * 3/2014 Bayerlein ..... A63B 22/0235 482/54
2014/0100491 A1 * 4/2014 Hu ..... A61H 3/008 601/27
2014/0201905 A1 * 7/2014 Glukhovsky ..... A61G 7/1001 5/81.1 R
2015/0320632 A1 * 11/2015 Vallery ..... A61H 3/008 482/69
2016/0005538 A1 * 1/2016 Koyanagi ..... H01F 41/048 505/433
2016/0136477 A1 * 5/2016 Bucher ..... A63B 22/02 482/4

FOREIGN PATENT DOCUMENTS

EP 0236976 A1 9/1987
WO 2007047852 A2 4/2007
WO 2013117750 A1 8/2013
WO 2013179230 A1 12/2013
WO 2015000800 A1 1/2015

OTHER PUBLICATIONS

Lovely, R. et al., "Effects of Training on the Recovery of Full-Weight-Bearing Stepping in the Adult Spinal Cat," Experimental Neurology, vol. 92, No. 2, May 1986, 15 pages.
Barbeau, H. et al., "Recovery of locomotion after chronic spinalization in the adult cat," Brain Research, vol. 412, No. 1, May 26, 1987, 12 pages.
Colgate, E. et al., "An Analysis of Contact Instability in Terms of Passive Physical Equivalents," Proceedings of the 1989 IEEE International Conference on Robotics and Automation, May 14, 1989, Scottsdale, Arizona, 6 pages.
Wernig, A. et al., "Laufband locomotion with body weight support improved walking in persons with severe spinal cord injuries," Paraplegia, vol. 30, No. 4, Apr. 1992, 10 pages.
Winter, D. et al., "An integrated EMG/biomechanical model of upper body balance and posture during human gait," Progress in Brain Research, vol. 97, Chapter 32, Available as Early as Jan. 1, 1993, 9 pages.
Wernig, A. et al., "Laufband Therapy Based on 'Rules of Spinal Locomotion' is Effective in Spinal Cord Injured Persons," European Journal of Neuroscience, vol. 7, No. 4, Apr. 1995, 7 pages.
Pratt, G. et al., "Stiffness Isn't Everything," Proceedings of the Fourth International Symposium on Experimental Robotics (ISER '95), Jun. 30, 1995, Stanford, California, 6 pages.
Basso, D. et al., "MASCIS Evaluation of Open Field Locomotor Scores: Effects of Experience and Teamwork on Reliability," Journal of Neurotrauma, vol. 13, No. 7, Jul. 1996, 17 pages.
Harkema, S. et al., "Human Lumbosacral Spinal Cord Interprets Loading During Stepping," Journal of Neurophysiology, vol. 77, No. 2, Feb. 1, 1997, 15 pages.
Brosamle, C. et al., "Cells of Origin, Course, and Termination Patterns of the Ventral, Uncrossed Component of the Mature Rat

(56) References Cited

OTHER PUBLICATIONS

Corticospinal Tract," The Journal of Comparative Neurology, vol. 386, No. 2, Sep. 22, 1997, 11 pages.
Kakulas, B., "A Review of the Neuropathology of Human Spinal Cord Injury with Emphasis on Special Features," Proceedings of the Donald Munro Memorial Lecture at the American Paraplegia Society 44th Annual Conference, Sep. 9, 1998, Las Vegas, Nevada, 6 pages.
Hashtrudi-Zaad, K. et al., "On the Use of Local Force Feedback for Transparent Teleoperation," Proceedings of the 1999 IEEE International Conference on Robotics and Automation, May 10, 1999, Detroit, Michigan, 7 pages.
Kirkwood, P., "Neuronal Control of Locomotion: From Mollusc to Man—G.N. Orlovsky, T.G. Deliagina and S. Grillner. Oxford University Press, Oxford, 1999. ISBN 0198524056 (Hbk), 322 pp.," Clinical Neurophysiology, vol. 111, No. 8, Aug. 1, 2000, Published Online Jul. 17, 2000, 2 pages.
Pratt, J. et al., "Series elastic actuators for high fidelity force control," Industrial Robot: An International Journal, vol. 29, No. 3, Available as Early as Jan. 1, 2002, 13 pages.
Steward, O. et al. "False Resurrections: Distinguishing Regenerated from Spared Axons in the Injured Central Nervous System," The Journal of Comparative Neurology, vol. 459, No. 1, Apr. 21, 2003, 8 pages.
Pearson, K., "Generating the walking gait: role of sensory feedback," Progress in Brain Research, vol. 143, Chapter 12, Published Online Nov. 28, 2003, 7 pages.
Bareyre, F. et al., "The injured spinal cord spontaneously forms a new intraspinal circuit in adult rats," Nature Neuroscience, vol. 7, No. 3, Mar. 2004, Published Online Feb. 15, 2004, 9 pages.
Carhart, M. et al., "Epidural Spinal-Cord Stimulation Facilitates Recovery of Functional Walking Following Incomplete Spinal-Cord Injury," IEEE Transactions on Neural Systems and Rehabilitation Engineering, vol. 12, No. 1, Mar. 15, 2004, 11 pages.
Liu, J. et al., "Stimulation of the Parapyramidal Region of the Neonatal Rat Brain Stem Produces Locomotor-Like Activity Involving Spinal 5-HT7 and 5-HT2A Receptors," Journal of Neurophysiology, vol. 94, No. 2, Aug. 1, 2005, Published Online May 4, 2005, 13 pages.
Timoszyk, W. et al., "Hindlimb loading determines stepping quantity and quality following spinal cord transection," Brain Research, vol. 1050, No. 1-2, Jul. 19, 2005, Published Online Jun. 24, 2005, 10 pages.
Wernig, A., "'Ineffectiveness' of Automated Locomotor Training," Archives of Physical Medicine and Rehabilitation, vol. 86, No. 12, Dec. 2005, 2 pages.
Nessler, J. et al., "A Robotic Device for Studying Rodent Locomotion After Spinal Cord Injury," IEEE Transactions on Neural Systems and Rehabilitation Engineering, vol. 13, No. 4, Dec. 12, 2005, 10 pages.
Reinkensmeyer, D. et al., "Tools for understanding and optimizing robotic gait training," Journal of Rehabilitation Research & Development, vol. 43, No. 5, Aug. 2006, 14 pages.
Frey, M. et al., "A Novel Mechatronic Body Weight Support System," IEEE Transactions on Neural Systems and Rehabilitation Engineering, vol. 14, No. 3, Sep. 18, 2006, 11 pages.
Cai, L. et al., "Implications of Assist-As-Needed Robotic Step Training after a Complete Spinal Cord Injury on Intrinsic Strategies of Motor Learning," The Journal of Neuroscience, vol. 26, No. 41, Oct. 11, 2006, 5 pages.
Courtine, G. et al., "Can experiments in nonhuman primates expedite the translation of treatments for spinal cord injury in humans?," Nature Medicine, vol. 13, No. 5, May 2007, 13 pages.
Drew, T. et al., "Cortical mechanisms involved in visuomotor coordination during precision walking," Brain Research Reviews, vol. 57, No. 1, Jan. 2008, Published Online Aug. 22, 2007, 13 pages.
Edgerton, V. et al., "Training Locomotor Networks," Brain Research Reviews, vol. 57, No. 1, Jan. 2008, Published Online Sep. 16, 2007, 25 pages.
Kwakkel, G. et al., "Effects of Robot-assisted therapy on upper limb recovery after stroke: A Systematic Review," Neruorehabilitation and Neural Repair, vol. 22, No. 2, Mar. 2008, Published Online Sep. 17, 2007, 17 pages.
Courtine, G. et al., "Recovery of supraspinal control of stepping via indirect propriospinal relay connections after spinal cord injury," Nature Medicine, vol. 14, No. 1, Jan. 6, 2008, 6 pages.
Cowley, K. et al., "Propriospinal neurons are sufficient for bulbospinal transmission of the locomotor command signal in the neonatal rat spinal cord," The Journal of Physiology, vol. 586, No. 6, Mar. 15, 2008, Published Online Jan. 31, 2008, 13 pages.
Vallery, H. et al., "Compliant Actuation of Rehabilitation Robots," IEEE Robotics & Automation Magazine, vol. 15, No. 3, Sep. 12, 2008, 10 pages.
Edgerton, V. et al., "Robotic Training and Spinal Cord Plasticity," Brain Research Bulletin, vol. 78, No. 1, Jan. 15, 2009, Published Online Nov. 14, 2008, 19 pages.
Fuentes, R. et al., "Spinal Cord Stimulation Restores Locomotion in Animal Models of Parkinson's Disease," Science, vol. 323, No. 5921, Mar. 20, 2009, 14 pages.
Musienko, P. et al., "Combinatory Electrical and Pharmacological Neuroprosthetic Interfaces to Regain Motor Function After Spinal Cord Injury," IEEE Transactions on Biomedical Engineering, vol. 56, No. 11, Nov. 2009, Published Online Jul. 24, 2009, 5 pages.
Alto, L. et al., "Chemotropic Guidance Facilitates Axonal Regeneration and Synapse Formation after Spinal Cord Injury," Nature Neuroscience, vol. 12, No. 9, Sep. 2009, Published Online Aug. 2, 2009, 22 pages.
Courtine, G. et al., "Transformation of nonfunctional spinal circuits into functional states after the loss of brain input," Nature Neuroscience, vol. 12, No. 10, Oct. 2009, Published Online Sep. 20, 2009, 12 pages.
Hagglund, M. et al., "Activation of groups of excitatory neurons in the mammalian spinal cord or hindbrain evokes locomotion," Nature Neuroscience, vol. 13, No. 2, Feb. 2010, Published Online Jan. 17, 2010, 8 pages.
Wessels, M. et al., "Body Weight-Supported Gait Training for Restoration of Walking in People With an Incomplete Spinal Cord Injury: A Systematic Review," Journal of Rehabilitation Medicine, vol. 42, No. 6, Jun. 2010, 7 pages.
Zorner, B. et al., "Profiling locomotor recovery: comprehensive quantification of impairments after CNS damage in rodents," Nature Methods, vol. 7, No. 9, Sep. 2010, Published Online Aug. 15, 2010, 11 pages.
Ada, L. et al., "Mechanically assisted walking with body weight support results in more independent walking than assisted overground walking in non-ambulatory patients early after stroke: a systematic review," Journal of Physiotherapy, vol. 56, No. 3, Sep. 2010, 9 pages.
Duschau-Wicke, A. et al., "Patient-cooperative control increases active participation of individuals with SCI during robot-aided gait training," Journal of NeuroEngineering and Rehabilitation, vol. 7, No. 43, Sep. 10, 2010, 13 pages.
Rosenzweig, E. et al., "Extensive Spontaneous Plasticity of Corticospinal Projections After Primate Spinal Cord Injury," Nature Neuroscience, vol. 13, No. 12, Dec. 2010, Published Online Nov. 14, 2010, 19 pages.
Hidler, J. et al., "ZeroG: Overground gait and balance training system," Journal of Rehabilitation Research & Development, vol. 48, No. 4, Available as Early as Jan. 1, 2011, 12 pages.
Musselman, K. et al., "Spinal Cord Injury Functional Ambulation Profile: A New Measure of Walking Ability," Neurorehabilitation and Neural Repair, vol. 25, No. 3, Mar. 2011, Published Online Feb. 25, 2011, 9 pages.
Harkema, S. et al., "Effect of Epidural stimulation of the lumbosacral spinal cord on voluntary movement, standing, and assisted stepping after motor complete paraplegia: a case study," The Lancet, vol. 377, No. 9781, Jun. 4, 2011, Published Online May 20, 2011, 17 pages.
Wirz, M. et al., "Effectiveness of automated locomotor training in patients with acute incomplete spinal cord injury: A randomized controlled multicenter trial," BMC Neurology, vol. 11, No. 60, May 27, 2011, 5 pages.

(56) References Cited

OTHER PUBLICATIONS

Musienko, P. et al., "Controlling specific locomotor behaviors through multidimensional monoaminergic modulation of spinal circuitries," The Journal of Neuroscience, vol. 31, No. 25, Jun. 22, 2011, 32 pages.
Musienko, P. et al. "Multi-system neurorehabilitative strategies to restore motor functions following severe spinal cord injury," Experimental Neurology, vol. 235, No. 1, May 2012, Published Online Sep. 7, 2011, 10 pages.
Gosselin, C. et al., "On the Development of a Walking Rehabilitation Device with a Large Workspace," Proceedings of the 2011 IEEE International Conference on Rehabilitation Robotics (ICORR), Jun. 29, 2011, Zurich, Switzerland, 6 pages.
Vallery, H. et al., "Multidirectional Transparent Support for Overground Gait Training," Proceedings of the 2013 IEEE International Conference on Rehabilitation Robotics (ICORR), Jun. 24, 2013, Seattle, Washington, 7 pages.
ISA European Patent Office, International Search Report and Written Opinion Issued in Application No. PCT/EP2016/065601, dated Aug. 12, 2016, WIPO, 16 pages.
Sun, F. et al., "Sustained axon regeneration induced by co-deletion of PTEN and SOCS3," Nature, vol. 480, No. 7377, Dec. 15, 2011, Published Online Nov. 6, 2011, 12 pages.
Von Zitzewitz, J. et al., "Use of Passively Guided Deflection Units and Energy-Storing Elements to Increase the Application Range of Wire Robots," In Book: Cable-Driven Parallel Robots, Springer-Verlag Heidelberg, Available Online Sep. 8, 2012, 18 pages.

* cited by examiner

APPARATUS TO APPLY FORCES IN A THREE-DIMENSIONAL SPACE

CROSS-REFERENCE TO RELATED APPLICATIONS

The present application is a U.S. National Phase of International Patent Application Serial No. PCT/EP2016/065601, entitled "APPARATUS TO APPLY FORCES IN A THREE-DIMENSIONAL SPACE," filed on Jul. 1, 2016. International Patent Application Serial No. PCT/EP2016/065601 claims priority to European Patent Application No. 15175238.3, filed on Jul. 3, 2015. The entire contents of each of the above-cited applications are hereby incorporated by reference in their entirety for all purposes.

FIELD OF THE INVENTION

The present invention relates to the field of robotic systems, in particular to robotic systems useful to apply forces to an object or a subject, in particular a person. It also relates to a robotic system useful to unload the object/person from its weight. More in particular, it relates to a robotic system useful in locomotor rehabilitation programs, for example in subjects suffering from spinal cord injuries or more generally to motion impairment.

BACKGROUND OF THE INVENTION

In locomotor rehabilitation of patients with neurological impairments gait and balance training is essential.

Robotic overhead support systems have been developed to help patients training, for example by relieving them of part of their body weight.

Existing body-weight support systems or overhead gantry cranes are either not three-dimensional, i.e. they do not allow three-dimensional gait training, or they have high friction and inertia, or they require a multitude of strong and powerful actuators.

Systems known in prior art are conceptualized as classical serial (gantry) or parallel mechanism. In the former case, they require movable gantries to allow three-dimensional application of forces, which involves a massive structure with high inertia. In the case of parallel mechanisms, the actuated degrees of freedom (DOFs) are not decoupled from each other. Therefore, all actuators move in case of a single-DOF movement. Due to this coupling, it is almost impossible to apply forces in a precise manner over a large workspace. Additionally, all actuators have to be dimensioned taking the fastest velocity and the highest force/torque into account which do not necessarily occur in the same DOF.

For example, in Gosselin et al., "On the development of a walking rehabilitation device with a large workspace." Rehabilitation Robotics (ICORR), 2011 IEEE International Conference on. IEEE, 2011, a fully passive system requiring a moving gantry is described. The system has the main objective to be able to follow the person with an overhead support and compensate part of its weight. The basic principle is a cable-routing system that follows the user in order to provide gravity compensation without hindering walking motions. Disadvantages of this system are its high inertia in the direction orthogonal to the moving gantry and that horizontal forces cannot be applied.

In WO2013117750 an apparatus for unloading a user's body weight, in particular for gait training, is disclosed. The apparatus is characterized by a plurality of ropes deflected by deflection devices and a node coupled to the free ends of said ropes and to a user. Drive units retract and release the ropes to adjust the rope force so as to obtain a resulting force exerted on the user via said node in order to unload the user and/or to exert a force on the user in a horizontal plane. This is a fully actuated system that requires strong and powerful actuators to work. This apparatus has been commercialized as THE FLOAT by Lutz Medical Engineering, Switzerland.

Similar systems are disclosed in Vallery, H., et al. "Multidirectional transparent support for overground gait training." *Rehabilitation Robotics* (*ICORR*), 2013 *IEEE International Conference on.* IEEE, 2013 and Von Zitzewitz, Joachim, et al. "Use of passively guided deflection units and energy-storing elements to increase the application range of wire robots." *Cable-Driven Parallel Robots.* Springer Berlin Heidelberg, 2013. 167-184.

These systems, which are a special class of parallel mechanisms, have the mentioned disadvantage that they require a multitude of strong and powerful actuators because the actuated degrees of freedom (DOFs) are not decoupled from each other.

Therefore, there is still the need of a system with low inertia in all DoFs which can be used to apply forces to a user in a precise manner over a large workspace while at the same time not requiring many strong actuators. More particularly, to apply forces in a precise manner means that the force rendering errors in each single DOF are at least one or two orders of magnitude smaller compared to the forces that the device aims to apply, for example to provide body weight support to a human user.

It is known from prior art that control performance in general can be improved by a minimal number of actuators and/or by letting high low-bandwidth forces be applied by different actuators than low high-bandwidth forces.

A specific mechanical configuration for the intended application, however, is unknown.

SUMMARY OF THE INVENTION

It has now been found an apparatus which allows the manipulation of forces in a three-dimensional space with far lower actuator requirements and a much higher precision than prior-art systems.

The apparatus of the invention combines passive and active elements to minimize actuation requirements while still keeping inertia to a minimum and control precision to a maximum.

Therefore, it has the advantages that it requires minimal actuators but at the same time has a low inertia.

Furthermore, thanks to the specific apparatus design the DOFs requiring a large workspace and high-speed movements are decoupled from the DOFs in which high static forces are applied. This is reached by arranging the actuators and the points to which they apply their force/torque in a different way than in prior art. Differently sized and configured actuators are used, each of which has a different target load and speed and/or drives a different DOF.

The approach of the apparatus of the present invention to decouple the selected DOFs and frequency domains as well as to place the passive elements to enable decoupling of system inertia solves the above mentioned problems in an effective and more easily practicable way.

It is an object of the present invention an apparatus to apply forces to an object or a subject, in particular a person (herein intended also as user) as defined in the appended independent claim.

Other objects of the present invention as well as embodiments of the same will be defined in the dependent claims.

In particular, the apparatus of the invention comprises one or more ropes (or wires) ($R_1$, $R_1'$) wherein each rope extends from a first associated drive unit ($A_a$, $A_c$,) to a first associated deflection device, respectively, ($D_1$, $D_3$) and is deflected by the latter, and wherein said one or more ropes ($R_1$, $R_1'$) are guided by said first deflection devices ($D_1$, $D_3$) toward a second associated deflection device, respectively, ($P_1$, $P_1'$), whereby said one or more ropes ($R_1$, $R_1'$) are deflected by said second deflection device ($P_1$, $P_1'$) toward a third deflection device respectively ($D_2$, $D_4$) that is connected to said first deflection device, particularly in a rigid or elastic manner, and said ropes are deflected by said third deflection device toward a second associated drive unit ($A_b$, $A_d$) or a fixed point in space or back to said first associated deflection device ($D_1$, $D_3$,), wherein said second deflection devices ($P_1$, $P_1'$) are connected to an object or a subject (user) and said drive units ($A_a$, $A_b$, $A_c$, $A_d$) apply forces ($F_a$, $F_b$, $F_c$, $F_d$) to the respective one or more ropes ($R_1$, R'), which forces add up to a current resulting force vector ($F_n$) exerted on said user via said second deflection devices ($P_1$, $P_1'$), in order to apply forces and/or moments on said object or user and/or to unload said object or user.

In one embodiment, said second deflection devices ($P_1$, $P_1'$) are interconnected one with each other to a user through one or more common coupling points.

According to this embodiment it is also provided a modular version of the apparatus wherein both sides can be used individually as 2D versions, for example for two patients.

In one embodiment, the apparatus of the invention further comprises one or more further drive units ($A_{ta}$, $A_{tb}$, $A_{tc}$, $A_{td}$) applying forces ($F_{ta}$, $F_{tb}$, $F_{tc}$, $F_{td}$) to each first and third deflection devices ($D_1$, $D_2$, $D_3$, $D_4$) thus resulting in additional horizontal and/or vertical force components of $F_n$ exerted on the user (4) via said second deflection devices ($P_1$, $P_1'$).

Said further forces ($F_{ta}$, $F_{tb}$, $F_{tc}$, $F_{td}$) can be applied to said first and third deflection devices ($D_1$, $D_2$, $D_3$, $D_4$) through one or more further ropes (X', X", X'", X"") extending from said one or more further drive units ($A_{ta}$, $A_{tb}$, $A_{tc}$, $A_{td}$) to said first and third deflection devices ($D_1$, $D_2$, $D_3$, $D_4$).

In a preferred embodiment, an elastic or viscoelastic connecting element ($Y_1$, $Y_2$, $Y_3$, $Y_4$), for example a spring or a rubber rope, is present between said one or more further ropes (X', X", X'", X") and the respective deflection device(s) ($D_1$, $D_2$, $D_3$, $D_4$).

In an embodiment, only one further drive unit ($A_{ta}$, $A_{tc}$) and only one further rope (X', X'") is present per each second deflection device ($P_1$, $P_1'$), said further rope extending from said first deflection device ($D_1$, $D_3$) through said further drive unit ($A_{ta}$, $A_{tc}$) to said associated third deflection device ($D_2$, $D_4$) via a suitable arrangement of additional fixed deflection devices, so that said further drive units ($A_{ta}$, $A_{tc}$) apply forces ($F_{ta}$, $F_{tb}$, $F_{tc}$, $F_{td}$) to said first and third deflection devices ($D_1$, $D_2$, $D_3$, $D_4$) through said only one further rope (X', X'") per second deflection device.

Alternatively, said further forces ($F_{ta}$, $F_{tb}$, $F_{tc}$, $F_{td}$) can be applied by one or more further drive units ($A_{ta}$, $A_{tb}$, $A_{tc}$, $A_{td}$) directly attached to said first and third deflection devices ($D_1$, $D_2$, $D_3$, $D_4$) via additional ropes.

In another embodiment, the free ends of said rope ($R_1$, $R_1'$) are interconnected so that only one rope is present.

In a further embodiment, both free ends of the rope ($R_1$, $R_1'$) after being deflected by said first, second, and third deflection devices ($D_1$, $D_3$, $P_1$, $P_1'$, $D_2$, $D_4$,) are guided backwards by said third ($D_2$, $D_4$) deflection device with a deflection angle >90° over the first deflection device ($D_1$, $D_3$) and then extend to the respective drive unit ($A_a$, $A_b$, $A_c$, $A_d$).

In a preferred embodiment, a connecting element ($C_1$, $C_2$) is present between said first and third deflection devices ($D_1$, $D_2$, $D_3$, $D_4$) so as to form a deflection unit.

More preferably, said connecting element ($C_1$, $C_2$) is elastic or viscoelastic, for example a spring or a rubber rope.

The use of an elastic element connecting said further drive units ($A_{ta}$, $A_{tb}$, $A_{tc}$, $A_{td}$) to said guided deflection devices ($D_1$, $D_2$, $D_3$, $D_4$) and/or said first and third guided deflection devices to each other is particularly advantageous since it decouples the motor inertia from the user so that the user does not perceive the inertia of the actuators. Furthermore, the use of an elastic element as a connecting element between said first and third guided deflection devices when further drive units are present allows to influence forces with high bandwidth in all DOFs by said further drive units ($A_{ta}$, $A_{tb}$, $A_{tc}$, $A_{td}$) acting on the deflection devices.

In another embodiment, all deflection devices ($D_1$, $D_2$, $D_3$, $D_4$, $P_1$, $P_1'$) are replaced by double deflection devices and the rope ($R_1$, $R_1'$) is guided twice over each pair of deflection device.

In a further embodiment, one free end of the rope ($R_1$, $R_1'$) is fixed to a fixed point in space.

In a preferred embodiment, the apparatus comprises a first and a second rope ($R_1$, $R_1'$) wherein the first rope ($R_1$) extends from a first associated drive unit ($A_c$) to a first associated deflection device ($D_3$) and is deflected by the latter, toward a second associated deflection device ($P_1$), is deflected by said second deflection device ($P_1$) toward a third deflection device ($D_4$) and is deflected by the latter toward a second associated drive unit ($A_d$), and the second rope ($R_1'$) extends from a first associated drive unit ($A_a$) to a first associated deflection device ($D_1$) and is deflected by the latter, toward a second associated deflection device ($P_1'$), is deflected by said second deflection device ($P_1'$) toward a third deflection device ($D_2$) and is deflected by the latter toward a second associated drive unit ($A_b$), so that said drive units ($A_a$, $A_b$, $A_c$, $A_d$) apply forces ($F_a$, $F_b$, $F_c$, $F_d$) to the respective ropes ($R_1$, $R_1'$), which forces add up to a current resulting force ($F_n$) exerted on said user via said second deflection devices ($P_1$, $P_1'$), in order to apply a force and/or a moment on said user and/or to unload said user.

Preferably, the first and third deflection devices ($D_1$, $D_2$, $D_3$, $D_4$) are designed to be slidably connected to guiding rails.

Preferably, the apparatus of the invention further comprises at least a first guide rail running along a longitudinal axis and a second guide rail running along a longitudinal axis both extending horizontally with respect to an operating position of the apparatus, said guide rails being designed to be connected to a support structure, particularly to a support frame or to a ceiling of a room and said guide rails running parallel with respect to each other.

It is another object of the present invention a method for controlling the above disclosed apparatus, said method comprising measuring the position of the first and third deflection devices along the guide rails, measuring the forces applied on the subject (user) or the object using said apparatus, measuring the amount of rope released from each drive unit, combining this information to calculate the position of the second deflection devices ($P_1$, $P_1'$), and providing a feedback to said drive units so that a given reference force or position is tracked, in particular to unload the user or to apply horizontal forces.

Preferably the position of the deflection devices along the guide rails is measured, for example via optical sensors or magnetic sensors. Preferably, also the forces in the ropes $R_1$ and $R_1'$ and/or in the connecting elements ($C_1$, $C_2$) between said first and third deflection devices and/or in the ropes connecting said further drive units ($A_{ta}$, $A_{tb}$, $A_{tc}$, $A_{ta}$) to said first and third deflection devices ($D_1$, $D_2$, $D_3$, $D_4$) are measured, particularly by measuring deformation of an elastic or viscoelastic element (for example a linear spring or a rubber rope) connected to the ropes in series. This measurement can particularly be performed via strain gauges, wire potentiometers, optical sensing, or capacitive sensing. Preferably, also all drive units are equipped with sensors to measure the amount of rope that has been released, particularly via encoders on the actuators or on the winch axes. Using this sensor information, the resulting force and moment applied to the user is calculated by a kinematic mapping from the forces in the ropes ($R_1$, $R_1'$) to force vector and a moment vector in Cartesian space.

In one aspect of the invention, the force applied on the object or person is controlled in a feedback-loop in such a way that a given reference force is tracked, particularly to unload the user or to apply horizontal forces. To this end, the measured force vector is compared to the reference force vector, and the torques applied by the drive units are adjusted in such a way as to decrease the difference between these two vectors (Cartesian-space control). Alternatively, the reference force vector and the current kinematic configuration of the system can be used to calculate individual reference forces for each single rope, and the torque of each individual drive unit is adjusted in such a way as to decrease the difference between the respective reference rope force and the measured rope force (drive unit-space control). In addition or alternatively, the drive unit torques can also be applied as to achieve a given desired movement of the deflection units, particularly to keep these centered above the user.

In another aspect of the invention, the drive units are used to control a certain position of the user. All the above applies in an analog way, only that not forces but positions are controlled either in Cartesian space or in drive unit space.

Preferably, the control is split into high-frequency and low-frequency portions, whereby said drive units ($A_a$, $A_b$, $A_c$, $A_d$) control primarily low-frequency portions, and said further drive units ($A_{ta}$, $A_{tb}$, $A_{tc}$, $A_{td}$) control primarily high-frequency portions.

DETAILED DESCRIPTION OF THE INVENTION

Definitions

Within the meaning of the present invention, the term "user" preferably refers to a human person, but may also refer to an animal or to any object that is to unload and/or move.

Preferably, said user is a subject affected by a spinal cord motor disorder, wherein for spinal cord motor disorder is intended a disorder wherein the spinal cord is damaged and locomotor and postural functions are impaired. A spinal cord motor disorder can be caused and subsequent to trauma, infection factors (for example, extrapulmonary tuberculosis), cancer diseases, Parkinson's disease, multiple sclerosis, amyotrophy lateral sclerosis or stroke. More preferably, said user is a subject affected by spinal cord injury. Within the meaning of the present invention, spinal cord injury refers to any injury to the spinal cord that is caused by trauma.

Within the meaning of the present invention, the term "deflection device" means a device which guides the rope and changes its direction, particularly guiding it into the workspace.

FIGURES

Figure 1:
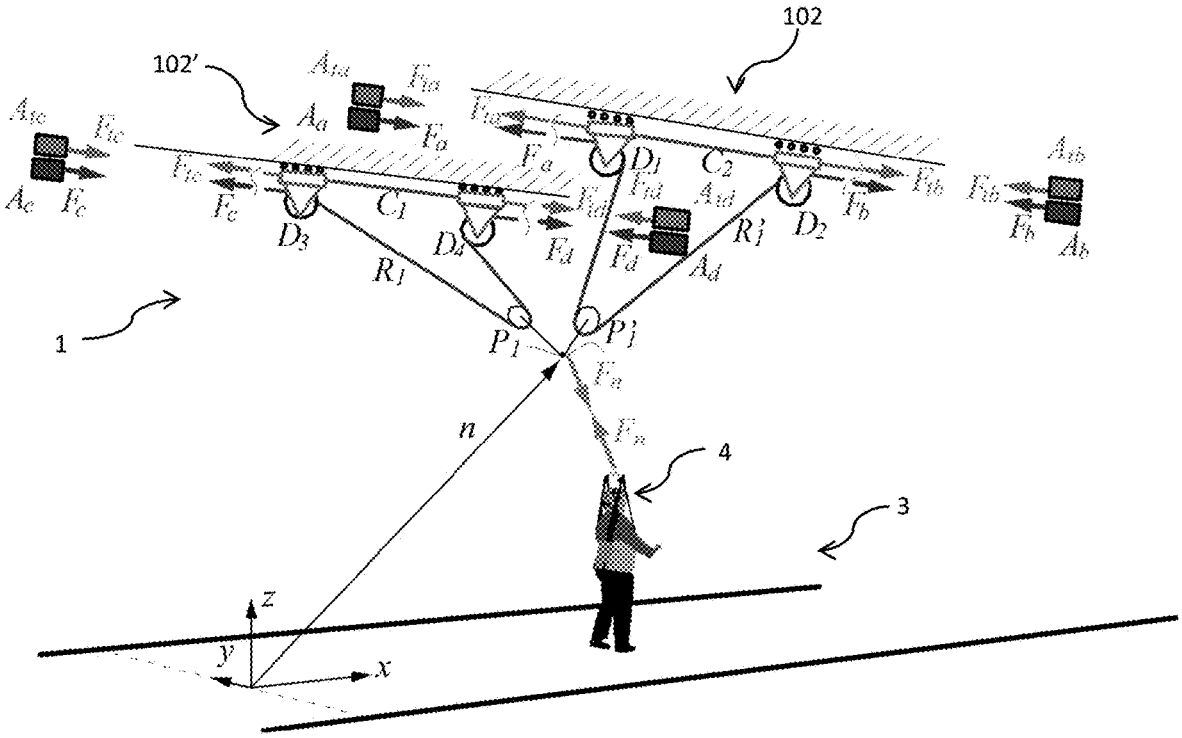
FIG. 1 shows an exemplary apparatus according to the invention in a support structure.

Preferably, the first and third deflection devices ($D_1$, $D_2$, $D_3$, $D_4$) are passively displaceable (i.e. can change their position in space, particularly in a guided manner), which particularly means that they do not themselves comprise a movement generating means for moving the respective deflection device actively, but can be displaced by forces induced into the deflection devices via the ropes connected to the user or via drive units attached to them via additional ropes.

Preferably, the first and third deflection devices ($D_1$, $D_2$, $D_3$, $D_4$) are connected to each other (for instance pairwise such that the respective two deflection devices can be displaced together while maintaining a constant distance between the deflections devices along the direction of displacement), and they may be guided by a guide rail or a plurality of guide rails or may be suspended from a support structure (e.g. support frame or ceiling of a room), particularly by means of a wire or another (elongated) supporting element such that their centers of mass can (passively)

change position in space. Likewise, said guide rail(s) may be connected to a support structure (e.g. support frame or ceiling).

However, in an embodiment of the invention, the deflection devices may be fixed such that they are not moving in space or along the guide rails. Particularly, the deflection devices can be designed to be fixed in a releasable manner to the guide rails so that the deflection units are temporarily lockable regarding their movement along the guide rails.

A connection between two (or even more) deflection elements can be provided by means of a (e.g. separate) connecting means (element), which may be interchangeable. Said connecting element is preferably elastic (particularly such that the restoring force is a function of the elongation of the elastic connecting element, particularly a linear function) or viscoelastic or non-elastic, so as to form a deflection unit (also denoted as trolley). Further, the respective connecting element may be a flexible rope member or a rigid rod (particularly produced out of a carbon fibre composite).

Deflection devices may also be integrally connected to each other (i.e. form a single piece).

Optionally, this connecting element can be realized via additional pulleys on either end of the rail, such that a tension spring in this connection generates forces that pushes the deflection devices apart instead of pulling them towards each other.

Each pair of first and third deflection devices ($D_1$, $D_2$, $D_3$, $D_4$) is used to guide a rope ($R_1$, $R_1'$) towards a freely moving, interconnected deflection device ($P_1$, $P_1'$).

In an embodiment of the invention, the apparatus comprises two ropes.

Preferably, the first rope extends from its first associated drive unit towards a first deflection device, is deflected by the first guided deflection device towards a second freely moving deflection device which deflects it to a third guided deflection device, preferably connected with said first deflection device, and then extends to a second associated drive unit. Likewise, the second rope extends from its first associated drive unit towards a first deflection device, is deflected by the first deflection device towards a second freely moving deflection device which deflects it to a third guided deflection device, preferably connected with said first deflection device and then extends to a second associated drive unit. The second deflection devices are connected to a common user and preferably also interconnected with each other through a common coupling point.

In another embodiment of the invention, in particular in the case of a human user, each of the second deflection devices can be connected to the respective shoulder of the user. Then the person could not rotate freely anymore, but rotation could be actuated.

Preferably, the first and third deflection devices are connected to each other on the same side to form a deflection unit, so that their combined movement is governed by (multiple) rope forces acting on them.

According to an aspect of the invention, the apparatus comprises at least a first guide rail and a second guide rail (for instance in case of two ropes), each running along a longitudinal axis. These longitudinal axes preferably extend horizontally with respect to an operating position of the apparatus, in which the apparatus can be operated (e.g. by the user) as intended. Preferably, the guide rail(s) can be connected to said support structure (e.g. support frame or ceiling of a room, in which the apparatus is arranged). In case of a support frame, the guide rail(s) may be connected to said upper frame part. Preferably, the guide rails are arranged such that they run parallel with respect to each other. Particularly, in case of two guide rails, each guide rail may be tilted about its longitudinal axis, particularly by an angle of 30° or 45° with respect to the vertical.

Preferably, the first and the third deflection device which guide a first rope are slidably connected to the first guide rail, so that they can slide along the first guide rail along the longitudinal axis of the first guide rail. In case of two ropes the first and the third deflection devices which guide a second rope are preferably slidably connected to the second guide rail, so that they can slide along the second guide rail along the longitudinal axis of the second guide rail.

In detail, said deflection devices may comprise a base (preferably in the form of a cart) slidably connecting the respective each deflection device to its associated guide rail. An arm hinged to its base can be provided for each deflection device so that each respective arm can be pivoted with respect to its base about a pivoting axis running parallel to the longitudinal axis of the respective guide rail. Each deflection device may also comprise a deflection element connected to the respective arm, for deflecting the respective rope around said deflection element. Each respective deflection element may be formed by a roller, which is rotatably supported on the respective arm, therefore the respective roller can be rotated about a rotation axis that is orthogonal to the longitudinal axis of the respective guide rail. If desired, arresting means can be provided for each deflection device for arresting the respective deflection device with respect to the associated guide rail, for instance when using the apparatus with a treadmill.

The first and third deflection devices guide the rope towards the second deflection devices. Differently from the above described first and third deflection devices, the second deflection devices are freely moving. Therefore, they are not connected to a guide rail but they can freely move in the workspace. They are connected to a user and preferably also interconnected with each other, e.g. by means of karabiners, and/or through one or more common coupling points to the user. In one embodiment, said second deflection devices are connected to a user through a single common point to which, for example, a harness is attached. In an alternative embodiment, said user is a human subject and second deflection devices are connected to the user by connecting each said second deflection device to one shoulder of the subject, such that rotation about the vertical axis can be induced and controlled.

In an embodiment, the free ends of the rope(s) is(are) connected to one or more drive units applying forces to said free ends.

In one embodiment, for each rope there are two drive units applying forces on the free ends of said rope. Preferably, the first drive unit of one rope and the second drive unit of the same rope face each other along the longitudinal axis of the first guide rail, wherein the first and the third deflection unit are arranged between said first and second drive units along the longitudinal axis of the guide rail.

In a preferred embodiment, one free end of each rope is connected to a drive unit, whereas the other free end of the same rope is fixed to a fixed point in space.

In a preferred embodiment, each drive unit $A_e$, $A_{te}$, $A_f$, $A_{tf}$ comprises an actuator 2 (for example a servo motor) which is connected to a winch, around which the respective rope is wound. A flexible coupling can be conveniently used. In this embodiment, each actuator is designed to exert a torque on the respective winch via a drive axis of the respective winch so as to retract or release the respective rope, i.e. to adjust the length of the respective rope that is unwound from the winch. If desired, each drive unit may comprise a brake for arresting the respective winch. Further, the drive unit preferably comprises at least one pressing member, for example in the form of a pressure roller pressing the respective rope being wound around the associated winch with a predefinable pressure against the winch in order to prevent the respective rope from jumping off the associated winch or over a thread. In an alternative embodiment, the drive units are manually operated.

Optionally, a force is applied to each guided deflection device by means of further drive units.

An exemplary embodiment of the apparatus according to the invention is depicted in FIG. 1.

The apparatus (1) comprises a suitable support structure (e.g. ceiling of the room where the apparatus is placed or a support frame—this latter not shown in FIG. 1), such that said support structure confines a three-dimensional working space (3), in which the user (4) can move along the horizontal x-y-plane (as well as vertically in case corresponding objects, e.g. inclined surfaces, staircases etc., are provided in the working space (3)). Said working space (3) then extends below said ceiling or frame.

Said support structure supports a first and a second guiding rail (102, 102'). The first guide rail 102 is designed to slidably support a two deflection devices $D_1$, $D_2$, and the second guide rail 102' is designed to slidably support two further deflection devices $D_3$, $D_4$. Here, the pair $D_1$, $D_2$ as well as the pair $D_3$, $D_4$ are connected by a connecting means $C_1$, $C_2$ so that the two pairs of deflection devices $D_1$-$D_2$ and $D_3$-$D_4$ each form a deflection unit (trolley) which can slide along the respective guide rail (102, 102').

A first rope $R_1$ extends from a first associated drive unit $A_c$ to a first associate deflection device $D_3$ and is deflected by $D_3$ and guided toward a second associated deflection device $P_1$. The rope $R_1$ is then deflected by said second deflection device $P_1$ toward a third deflection device $D_4$, which is connected to said first deflection device $D_3$ through a connecting element $C_1$, and then extends to a second associated drive unit $A_d$.

Said drive units $A_d$, $A_c$ apply forces $F_d$, $F_c$ to the rope $R_1$ retracting and releasing it.

A second rope $R_1'$ extends from a first associated drive unit $A_a$ to a first associate deflection device $D_1$ and is deflected by $D_2$ and guided toward a second associated deflection device $P_1'$. The rope $R_1'$ is deflected by said second deflection device $P_1'$ toward a third deflection device $D_2$, which is connected to said first deflection device $D_1$ through a connecting element $C_2$, and then extends to a second associated drive unit $A_b$.

Said drive units $A_a$, $A_b$ apply forces $F_a$, $F_b$ to the rope $R_1'$ retracting and releasing it. Preferably, said connecting elements $C_1$, $C_2$ are elastic or viscoelastic. A damper can also be used.

Said second deflection devices $P_1$, $P_1'$ are coupled to a user and preferably also interconnected one with each other.

A resulting force $F_n$ is generated which is exerted on the user via deflection devices $P_1$, $P_1'$. In such a way the user is partially unloaded of its weight and a force is applied on the user.

Furthermore, a force is applied to each first and third deflection device $D_1$, $D_2$, $D_3$, $D_4$ by means of further drive units $A_{ta}$, $A_{tb}$, $A_{tc}$, $A_{td}$. In particular, drive unit $A_{ta}$ exerts on deflection device $D_1$ a force $F_{ta}$ through rope X'. Drive unit $A_{tb}$ exerts on deflection device $D_2$ a force $F_{tb}$ through rope X". Drive unit $A_{tc}$ exerts on deflection device $D_3$ a force $F_{tc}$ through rope X'". Drive unit $A_{td}$ exerts on deflection device $D_4$ a force $F_{td}$ through rope X"".

Forces $F_{ta}$, $F_{tb}$, $F_{tc}$, $F_{td}$ are applied in parallel directions with respect to the guide rails.

Their combined action results in additional horizontal and/or vertical force components which modify the resulting force $F_n$ exerted on the user.

Figure 2:
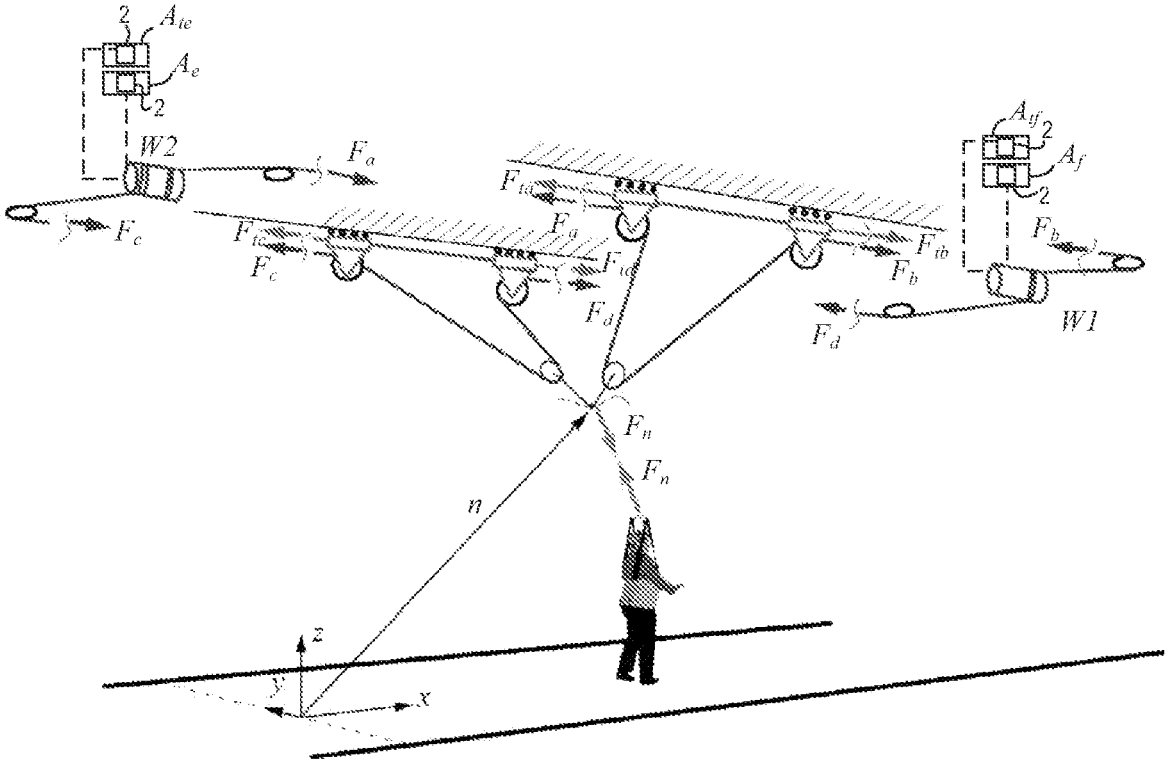
FIG. 2 shows an exemplary apparatus according to an embodiment of the invention in a support structure.

An embodiment of the invention is represented in FIG. 2.

In said embodiment, the free ends of each rope ($R_1$, $R_1'$) are interconnected so that only one rope is present.

One free end extends from a first actuated winch (drive unit) $W_1$ to a second actuated winch (drive unit) $W_2$ and then back to said first actuated winch $W_1$, wherein both free ends are wound up. Each winch $W_1$, $W_2$ is preferably placed between the ends of the guiding rails, one facing the other.

In this embodiment, $R_1$ and $R_1'$ refer to each rope part extending from a first drive unit (or winch) to a second drive unit (or winch).

Preferably, the winch $W_1$, $W_2$ is a torque- or position-controlled winch. A torque-controlled winch provides an actuator torque that aims to decrease the difference between a given reference torque and the currently measured torque, particularly as measured from the force ensors in the ropes or calculated from current measurement of the actuator unit. A position-controlled winch provides an actuator torque that aims to decrease the difference between a reference length for the rope that is released and the actual length of rope released, particularly as measured by an encoder on the drive unit. The reference force or position is provided by a control algorithm, particularly as the one described earlier.

Typically, one of the two winches, for example $W_1$, acts by changing the overall length of the rope while the other, for example $W_2$, has the role of manipulating the relative lengths of the rope parts $R_1$ and $R_1'$.

Optionally, only one of the two winches is present, for example $W_1$.

Similar to the previous exemplary embodiment, winch $W_1$ apply forces $F_b$, $F_d$ to the rope retracting and releasing it, while winch $W_2$ apply forces $F_a$, $F_c$ to the rope retracting and releasing it.

Figure 3:
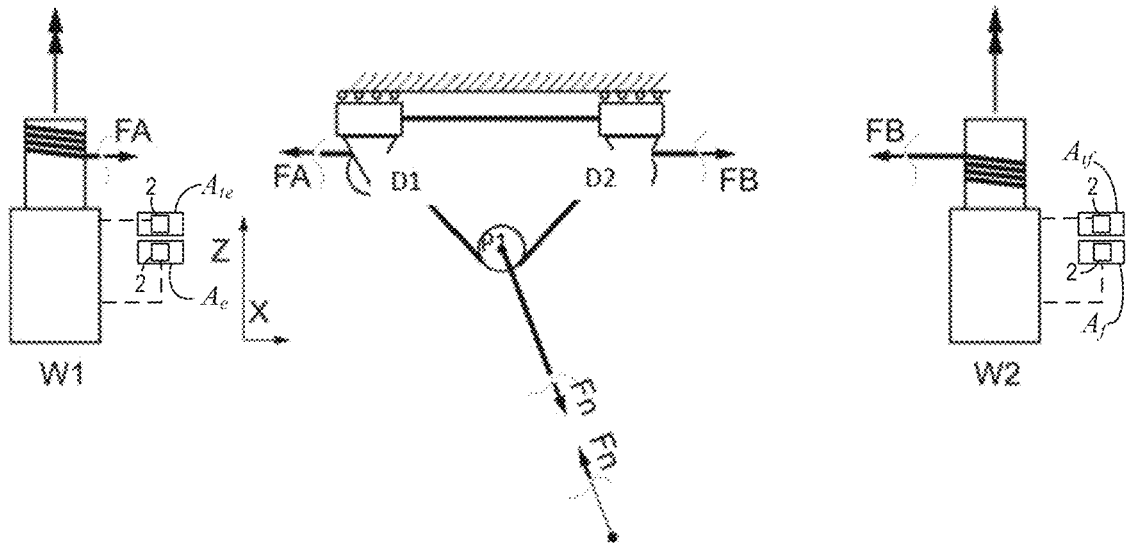
FIG. 3 shows a 2D configuration of an embodiment of the apparatus of the invention. This can be combined with a second identical mechanism by connecting the second deflection devices (P1, P1').

A 2D configuration of this same embodiment is represented in FIG. 3, wherein both ends of the rope are connected to winches $W_1$, $W_2$ so that forces $F_a$, $F_b$ are respectively generated on the rope by said winches $W_1$ and $W_2$. A resulting force $F_n$ is exerted on the user.

As for the exemplary embodiment above described, forces $F_{ta}$, $F_{tb}$, $F_{tc}$, $F_{td}$ are applied on the deflection devices in parallel directions with respect to the guide rails by drive units not shown in the picture.

All embodiments of the apparatus of the invention that are depicted as 2D configurations are preferably intended to be deployed in a 3D configuration as depicted in FIG. 1 or 2 by means of duplicating the mechanisms and interconnecting the second deflection devices $P_1$ and $P_1'$ directly or through connection to a common user. Since the focus is on the connection of the deflection devices, the various configurations are only shown in 2D.

Figure 4:
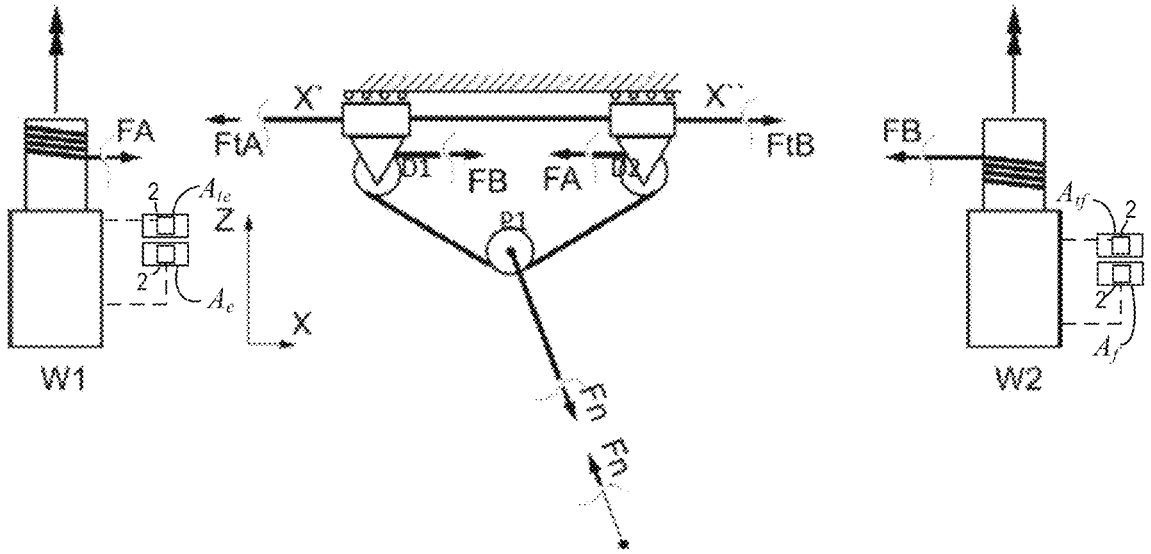
FIG. 4 shows a 2D configuration of an embodiment of the apparatus of the invention. This can be combined with a second identical mechanism by connecting the second deflection devices (P1, P1').

A further embodiment of the invention is represented in FIG. 4.

As explained above, this embodiment is intended to be realized in a three-dimensional configuration but is herein depicted on a two-dimensional configuration for ease of representation.

In this embodiment, both free ends of the rope $R_1$ after being deflected by deflection devices $D_1$, $P_1$ and $D_2$ are guided backwards, with a deflection angle >90°, over the guided deflection devices $D_1$, $D_2$ and then connected to motorized winches $W_1$, $W_2$.

Forces $F_a$, $F_b$ are respectively generated on the rope by said winches $W_1$ and $W_2$.

The configuration is represented only for one rope or part of the rope $R_1$ but it is intended to be the same for the other rope or part of the rope $R_1'$.

Preferably, an elastic connecting element is also present between deflection devices $D_1$, $D_2$ so that said deflection devices $D_1$, $D_2$ are pushed apart instead of being pulled towards each other.

The advantage of this configuration is that when the force on the rope or part of the rope $R_1$ increases, the deflection devices $D_1$ and $D_2$ on the same rail will move towards each other, and vice versa. That in turn reduces the difference in forces between rope or part of the rope $R_1$ and rope or part of the rope $R_1'$.

This is particularly advantageous, for example, when the user moves in y direction with a desired constant force $F_n$ pointing in z direction.

For appropriately dimensioned elastic element, this can even lead to zero torque to be applied by winch $W_1$ over a certain range of y positions, said range being between −1 m and +1 m of lateral movement. In these cases the rope parts $R_1$, $R_1'$ can be connected directly to each other, without using winch $W_1$.

Preferably, in this embodiment deflection devices $D_1$ and $D_2$ are not fully aligned with respect to the guiding rail.

Figure 5:
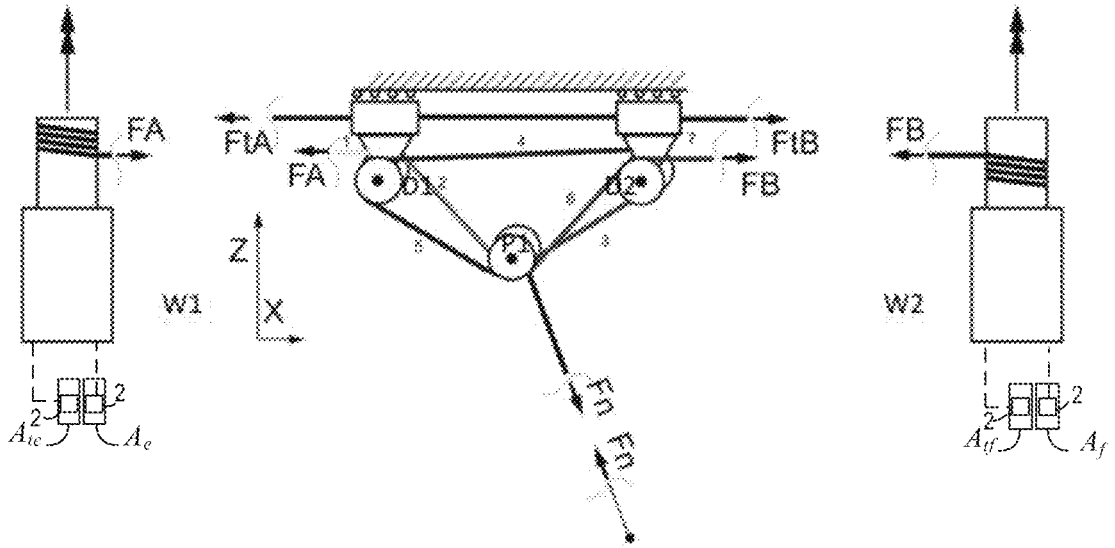
FIG. 5 shows a 2D configuration of an embodiment of the apparatus of the invention. This can be combined with a second identical mechanism by connecting the second deflection devices (P1, P1').

A further embodiment of the invention is represented in a 2D configuration in FIG. 5.

This embodiment is intended to be realized in a three-dimensional configuration but is herein depicted on a two-dimensional configuration for ease of representation.

The configuration is represented only for one part of the rope $R_1$ but it is intended to be the same for the other part of the rope $R_1'$.

In this embodiment, all deflection devices $D_1$, $D_2$, $P_1$ are replaced by double deflection devices and the rope $R_1$ is guided twice over each pair of deflection device.

In particular, the rope $R_1$ extends from a first winch $W_1$ and is guided over one pair of guided deflection devices $D_1$, then guided towards a pair of freely moving deflection device $P_1$ and via this one guided to the third pair of deflection devices $D_2$ guided by the same rail, then deflected by them back to $D_1$, then again to $P_1$, from these again to $D_2$, and finally to the second winch W2.

One advantage of this configuration is that in a 3D configuration there are in total eight rope parts that support the load $F_n$ thus reducing the necessary load of $W_2$.

Further advantages are that it is easier to guide the ropes and that $D_1$ and $D_2$ may stay aligned, differently from the embodiment depicted in FIG. 4.

Preferably, an elastic connecting element is present between deflection devices $D_1$, $D_2$ so that said deflection devices $D_1$, $D_2$ are pushed apart instead of being pulled towards each other.

As for the exemplary embodiment above described, forces $F_{ta}$, $F_{tb}$ are applied on the deflection devices in parallel directions with respect to the guide rails by drive units not shown in the picture.

Figure 6:
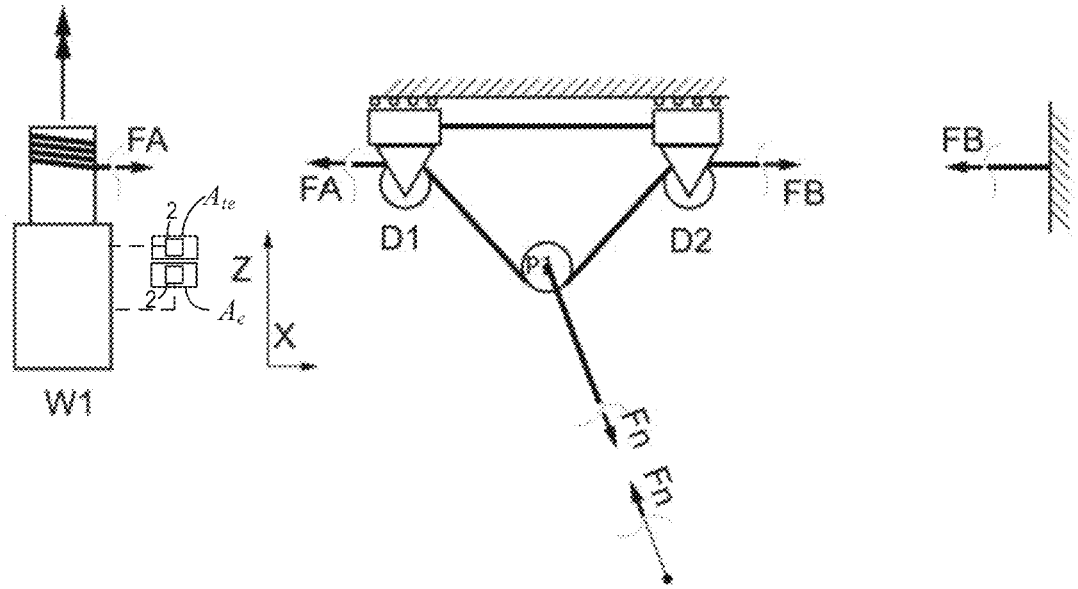
FIG. 6 shows a 2D configuration of an embodiment of the apparatus of the invention. This can be combined with a second identical mechanism by connecting the second deflection devices (P1, P1').

A further embodiment of the invention is represented in a 2D configuration in FIG. 6.

In this embodiment, one free end of each rope $R_1$ is fixed at one end of each respective guiding rail.

The remaining free end is connected to a respective motorized winch $W_1$ on the opposite end of the guiding rail, or all the free ends of each rope are connected to a joint winch $W_2$ on the opposite end of the guiding rail.

In all the above embodiments, one drive unit (or winch) can be replaced by the fixation of one free end of the rope $R_1$, $R_1'$ to a fixed point (for example a wall or the end of the guiding rail).

In further embodiments of the invention a one- or bi-directional force is applied to each guided deflection device $D_1$, $D_2$, $D_3$, $D_4$ by means of further drive units $A_{ta}$, $A_{tb}$, $A_{tc}$, $A_{ta}$.

By means of these drive units, forces in parallel direction with respect to the rails are applied to the deflection devices $D_1$, $D_2$, $D_3$, $D_4$ and, therefore, to the user.

Figure 7:
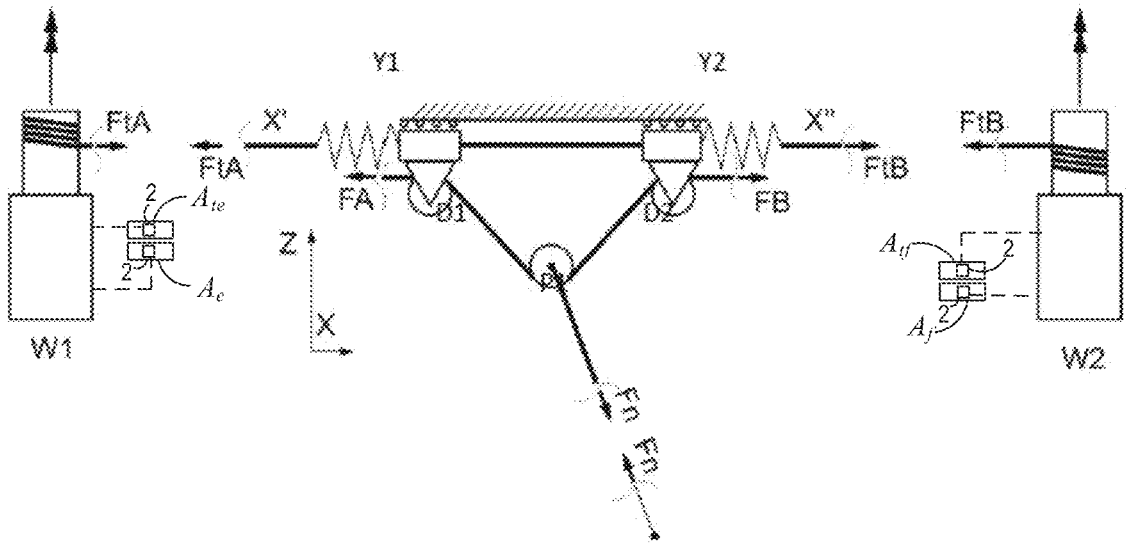
FIG. 7 shows a 2D configuration of an embodiment of the apparatus of the invention. This can be combined with a second identical mechanism by connecting the second deflection devices (P1, P1').

In this respect, an embodiment of the invention is represented in a 2D configuration in FIG. 7, wherein two motorized winches $W_1$, $W_2$ pull on respectively ropes X', X" connected directly via springs (depicted) to the deflection devices $D_1$, $D_2$ thus applying on said deflection devices a force $F_{ta}$ and a force $F_{tb}$, respectively.

Figure 8:
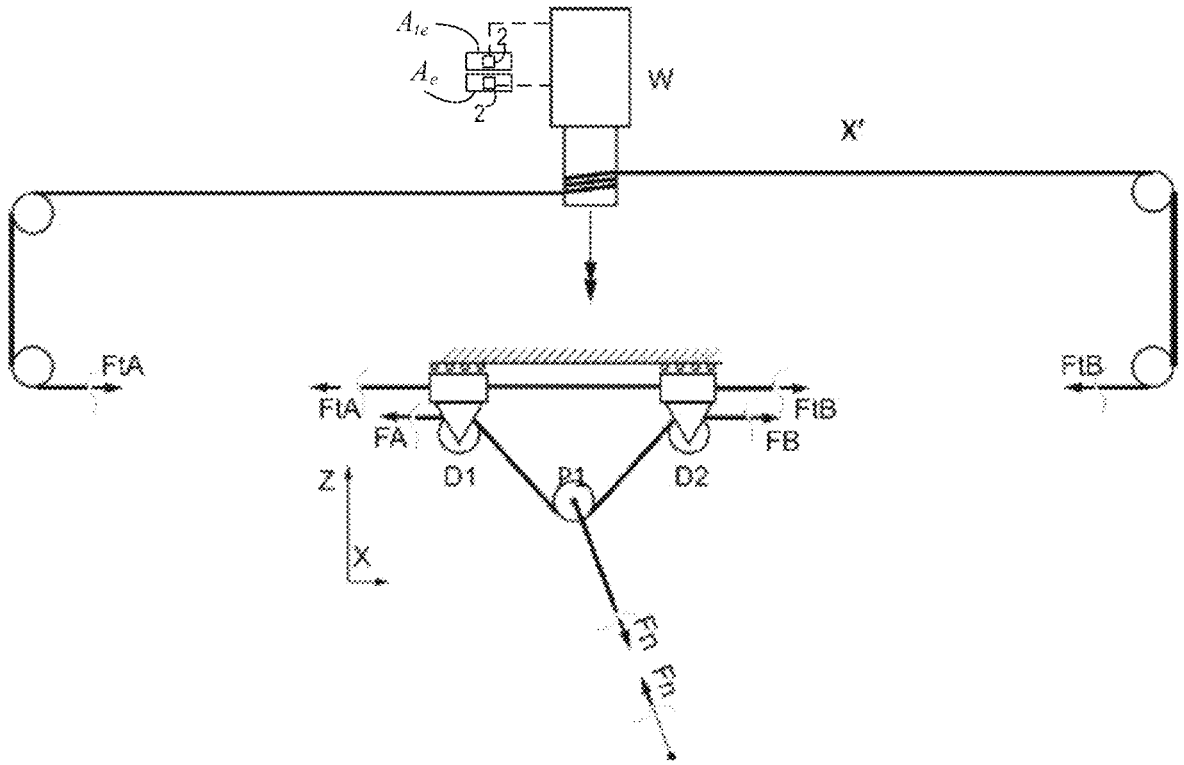
FIG. 8 shows a 2D configuration of an embodiment of the apparatus of the invention. This can be combined with a second identical mechanism by connecting the second deflection devices (P1, P1').

An alternative embodiment is depicted in FIG. 8.

Here, a single motorized winch W pulls on one rope $R_1$ whose free ends are connected to the deflection devices $D_1$, $D_2$. Forces $F_{ta}$, $F_{tb}$ are thus applied on the deflection devices $D_1$, $D_2$.

The advantage of this configuration is that only one motor is needed instead of two to apply forces to the two guided deflection devices $D_1$, $D_2$.

The disadvantage is that no opposed forces can be generated on the two guided deflection devices $D_1$, $D_2$.

Figure 9:
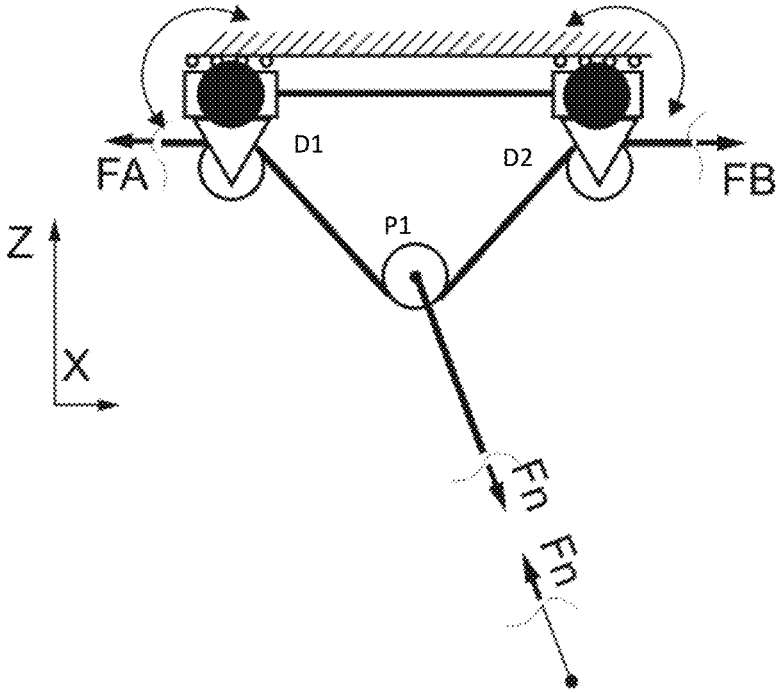
FIG. 9 shows a 2D configuration of an embodiment of the apparatus of the invention. This can be combined with a second identical mechanism by connecting the second deflection devices (P1, P1').

A further alternative embodiment is depicted in FIG. 9.

Here, the deflection devices $D_1$, $D_2$ are directly actuated, e.g. by actuators directly attached to the carts of the deflection devices via additional ropes (not depicted in the figure). Therefore, forces $F_{ta}$, $F_{tb}$ are applied to the deflection devices $D_1$, $D_2$.

The advantage is that no winches are needed to wind up the rope attached to the deflection devices. The disadvantage is the increased mechanical complexity (guidance of actuator cables and guidance system) and the potentially increased inertia.

Figure 10:
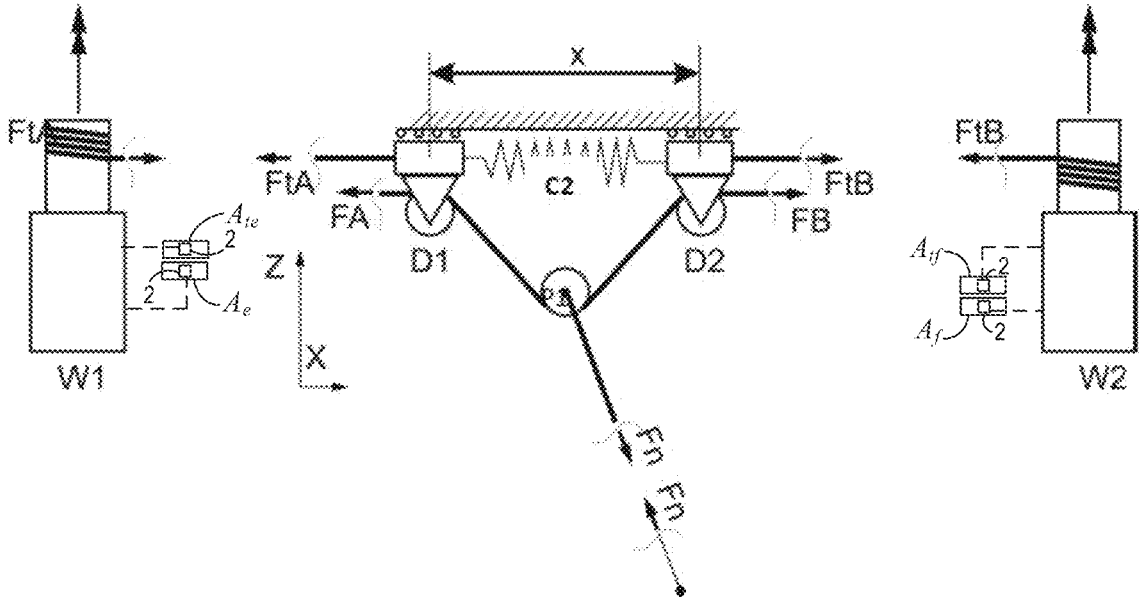
FIG. 10 shows a 2D configuration of an embodiment of the apparatus of the invention. This can be combined with a second identical mechanism by connecting the second deflection devices (P1, P1').

A further embodiment of the apparatus according to the present invention is represented in FIG. 10.

In this embodiment, the guided deflection devices $D_1$, $D_2$ are connected by means of an elastic element $C_2$.

In such a way, when opposed forces are applied on said deflection devices by the drive units, the distance between said devices changes.

For example, if four motorized winches Wi-W4 are present (only two are depicted in FIG. 10 for ease of representation) and they all pull with the same force on the ropes X', X" connected to the deflection devices $D_1$, $D_2$, the vertical force on the user is released with an increase of forces $F_{ta}$, $F_{tb}$, $F_{tc}$, $F_{td}$.

If only the motorized winches on one guiding rail $W_1$, $W_2$ pull with about the same force, then the user is pulled towards the opposite guiding rail.

If unilateral forces with equal direction are applied to both pairs of guided deflection units $D_1$-$D_2$ and $D_3$-$D_4$, a force in x-direction is generated on the user.

If unilateral forces with opposed direction are applied to both pairs of guided deflection units $D_1$-$D_2$ and $D_3$-$D_4$, the vertical force is increased.

In an embodiment, deflection devices $P_1$, $P_1'$ are connected to the user through two different coupling points. In this case, if unilateral forces with opposed direction are applied to both pairs of guided deflection units $D_1$-$D_2$ and $D_3$-$D_4$, a rotation of the user about the vertical axis is induced.

In a preferred embodiment, this configuration is used together with the configuration depicted in FIG. 4, i.e. with both free ends of the ropes or rope parts $R_1$ and $R_1'$ guided backwards over the guided deflection devices.

In this case, the influence of actuation on the deflection devices is inverted, and required actuator forces for y-actuation and z-actuation are generally reduced.

In an alternative embodiment, this configuration is used together with the configuration depicted in FIG. 5, i.e. with all deflection devices replaced by double deflection devices.

Also in this case, the influence of actuation on the deflection devices is inverted, and required actuator forces for y-actuation and z-actuation are generally reduced.

The apparatus herein disclosed is also for use and in a method in restoring voluntary control of locomotion in a subject suffering from a neuromotor impairment.

Generally, the apparatus according to the present invention is for use and in a method for locomotor rehabilitation of a subject, in particular a human, suffering from locomotor impairment, as detailed in the specification.

In the unitary concept of the present invention, the apparatus of the present invention, is for the above mentioned uses, optionally in combination with a device for epidural and/or subdural electrical stimulation, and further optionally in combination with a cocktail comprising a combination of agonists to monoaminergic receptors, as disclosed for example in WO2013179230, WO2015000800.

The invention claimed is:

1. An apparatus comprising:

one or more ropes or wires, wherein each rope or wire extends from a first associated drive unit to a first associated deflection device, respectively, and is deflected by the latter, wherein said one or more ropes or wires are guided by said first associated deflection device toward a second associated deflection device, respectively, by which said one or more ropes or wires are deflected by said second associated deflection device toward a third associated deflection device respectively, that is connected to said first associated deflection device, wherein said one or more ropes or wires are deflected by said third associated deflection device toward a second associated drive unit, and wherein said second associated deflection device is connected to an object or configured to connect to a user and said first and second associated drive units apply forces to the respective one or more ropes or wires, which forces add up to a current resulting force vector exerted on said object or said user via said second associated deflection device, in order to apply forces and/or moments on said object or said user and/or to unload said object or said user; and wherein the apparatus comprises one further associated drive unit per each second associated deflection device in addition to the first and second associated drive units, said one further associated drive unit applying forces to each of the first and third associated deflection devices, thus resulting in additional horizontal and/or vertical force components of Fn exerted on said object or said user via said second associated deflection device, and one further rope or wire per each second associated deflection device, in addition to said one or more ropes or wires, said one further rope or wire extending from said further respective associated drive unit through said first associated deflection device to said third associated deflection device so that said further associated drive unit applies forces to each second associated deflection device through said further rope or wire.

2. The apparatus according to claim 1, wherein said second associated deflection device is interconnected to said object or said user through one or more common coupling points.

3. The apparatus according to claim 1, wherein said additional horizontal and/or vertical force components are applied to said first and third associated deflection devices through said one further rope or wire extending from said one further associated drive unit per each second associated deflection device to said first and third associated deflection devices.

4. The apparatus according to claim 1, wherein said additional horizontal and/or vertical force components are applied by said one further associated drive unit per each second associated deflection device, said one further associated drive unit per each second associated deflection device directly attached to said first and third associated deflection devices via said one further rope or wire.

5. The apparatus according to claim 1, wherein said one further associated drive unit per each second associated deflection device connected to said first associated deflection devices through an elastic or viscoelastic connecting element, wherein said connecting element is a spring or a rubber rope.

6. The apparatus according to claim 1, wherein said one further rope or wire is present between said first and third associated deflection devices so as to form a single deflection unit.

7. The apparatus according to claim 1, wherein said first and third associated deflection devices are slidably connected to a guide rail.

8. The apparatus according to claim 1, wherein said apparatus further comprises at least a first guide rail running along a longitudinal axis and a second guide rail running along the longitudinal axis, the first guide rail and the second guide rail both extending horizontally with respect to an operating position of the apparatus, said first guide rail and said second guide rail being connectable to a support structure.

9. The apparatus according to claim 1, wherein said first associated drive unit and said second associated drive unit control a position of said object or said user, or forces/moments acting on said object or said user, and wherein control is split into high-frequency and low-frequency portions, whereby said first and second associated drive units control primarily low-frequency portions and said further drive units control primarily high-frequency portions.

10. The apparatus of claim 1, wherein said second associated drive unit is a winch.

11. An apparatus comprising:

one or more ropes or wires, wherein each rope or wire extends from a first associated drive unit to a first associated deflection device, respectively, and is deflected by the latter, wherein said one or more ropes or wires are guided by said first associated deflection device toward a second associated deflection device, respectively, by which said one or more ropes or wires are deflected by said second associated deflection device toward a third associated deflection device respectively, that is connected to said first associated deflection device, and wherein said one or more ropes or wires are deflected by said third associated deflection device toward a second associated drive unit, and wherein said second associated deflection device is connected to an object or configured to connect to a user and said first and second associated drive units apply forces to the respective one or more ropes or wires, which forces add up to a current resulting force vector exerted on said object or said user via said second associated deflection device, in order to apply forces and/or moments on said object or said user and/or to unload said object or said user; and one or more further drive units applying forces to each of the first and third associated deflection devices, thus resulting in additional horizontal and/or vertical force components of $F_n$ exerted on said object or said user via said second associated deflection devices, wherein said one or more further drive units are connected to said first associated deflection device through an elastic or viscoelastic connecting element, wherein said connecting element is a spring or a rubber rope.

12. An apparatus, comprising:

one or more ropes or wires wherein each rope or wire extends from a first associated drive unit to a first associated deflection device, respectively, and is deflected by the latter, wherein said one or more ropes or wires are guided by said first associated deflection device toward a second associated deflection device, respectively, by which said one or more ropes or wires are deflected by said second associated deflection device toward a third associated deflection device respectively, that is connected to said first associated deflection device, wherein said one or more ropes or wires are deflected by said third associated deflection device toward a second associated drive unit, wherein said second associated deflection device is connected to an object or configured to connect to a user and said first and second associated drive units apply forces to the respective one or more ropes or wires, which forces add up to a current resulting force vector exerted on said object or said user via said second associated deflection device, in order to apply forces and/or moments on said object or said user and/or to unload said object or said user, and wherein free ends of each of said one or more ropes or wires are interconnected.

13. The apparatus of claim 12, wherein one free end of the interconnected free ends extends from said first associated drive unit to said second associated drive unit and then back to said first associated drive unit, wherein the one free end is wound up to an other free end of said interconnected free ends, and wherein the first associated drive unit and said second associated drive unit are actuated.

14. The apparatus of claim 12, wherein both free ends of each of said one or more ropes or wires extend from said first associated drive unit to said first associated deflection device, are deflected by said first and second associated deflection devices towards said third associated deflection device, and are guided backwards by said third associated deflection device with a deflection angle >90° over said first associated deflection devices and extend to the second associated drive unit.

15. An apparatus, comprising:

one or more ropes or wires, wherein each rope or wire extends from a first associated drive unit to a first associated deflection device, respectively, and is deflected by the latter, wherein said one or more ropes or wires are guided by said first associated deflection device toward a second associated deflection device, respectively, by which said one or more ropes or wires are deflected by said second associated deflection device toward a third associated deflection device respectively, that is connected to said first associated deflection device, wherein said one or more ropes or wires are deflected by said third associated deflection device toward a second associated drive unit, wherein said second associated deflection device is connected to an object or configured to connect to a user and said first and second associated drive units apply forces to the respective one or more ropes or wires, which forces add up to a current resulting force vector exerted on said object or said user via said second associated deflection device, in order to apply forces and/or moments on said object or said user and/or to unload said object or said user, wherein a connecting element is present between said first and third associated deflection devices so as to form a single deflection unit, and wherein said connecting element is elastic.

16. An apparatus, comprising:

one or more ropes or wires wherein each rope or wire extends from a first associated drive unit to a first associated deflection device, respectively, and is deflected by the latter, wherein said one or more ropes or wires are guided by said first associated deflection device toward a second associated deflection device, respectively, by which said one or more ropes or wires are deflected by said second associated deflection device toward a third associated deflection device respectively, that is connected to said first associated deflection device, wherein said one or more ropes or wires are deflected by said third associated deflection device toward a second associated drive unit, wherein said second associated deflection device is connected to an object or configured to connect to a user and said first and second associated drive units apply forces to the respective one or more ropes or wires, which forces add up to a current resulting force vector exerted on said object or said user via said second associated deflection devices, in order to apply forces and/or moments on said object or said user and/or to unload said object or said user, and wherein each associated deflection device is a double deflection device and the one or more ropes or wires are guided twice over each pair of deflection devices.

17. An apparatus, comprising:

one or more ropes or wires, wherein each rope or wire extends from a first associated drive unit to a first associated deflection device, respectively, and is deflected by the latter, wherein said one or more ropes or wires are guided by said first associated deflection device toward a second associated deflection device, respectively, by which said one or more ropes or wires are deflected by said second associated deflection device toward a third associated deflection device respectively, that is connected to said first associated deflection device, wherein said one or more ropes or wires are deflected by said third associated deflection device toward a second associated drive unit, and wherein said second associated deflection device is connected to an object or configured to connect to a user and said first and second associated drive units apply forces to the respective one or more ropes or wires, which forces add up to a current resulting force vector exerted on said object or said user via said second associated deflection device, in order to apply forces and/or moments on said object or said user and/or to unload said object or said user, and wherein said first and second associated drive units and one or more further drive units control a certain position of said object or said user or forces/moments acting on said object or said user and the control is split into high-frequency and low-frequency portions, whereby said associated drive units control primarily low-frequency portions and said one or more further drive units control primarily high-frequency portions.

18. An apparatus, comprising:

one or more ropes or wires, wherein each rope or wire extends from a first associated drive unit to a first associated deflection device, respectively, and is deflected by the latter, wherein said one or more ropes or wires are guided by said first associated deflection device toward a second associated deflection device, respectively, by which said one or more ropes or wires are deflected by said second associated deflection device toward a third associated deflection device, respectively, that is connected to said first associated deflection device, wherein said one or more ropes or wires are deflected by said third associated deflection device toward a second associated drive unit, and wherein said second associated deflection device is connected to an object or configured to connect to a user and said first and second associated drive units apply forces to the respective one or more ropes or wires, which forces add up to a current resulting force vector exerted on said object or said user via said second associated deflection device, in order to apply forces and/or moments on said object or said user and/or to unload said object or said user; and one or more further drive units that apply forces to each of the first and third associated deflection devices, thus resulting in additional horizontal and/or vertical force components of Fn exerted on said object or said user via said second associated deflection device, and a force sensor that measures a force in the one or more ropes or wires, and wherein a torque of one or more of said first associated drive unit and said second associated drive unit is adjusted responsive to said measured force.

19. The apparatus of claim 18, wherein the first associated deflection device and the third associated deflection device are connected via a connecting element, wherein the connecting element is rigid.

20. The apparatus of claim 19, wherein the first associated deflection device and the third associated deflection device each comprise a cart that slidably connects the first associated deflection device and the third associated deflection device to respective guide rails.

21. The apparatus of claim 20, further comprising a further rope or wire, wherein the further rope or wire is in addition to said one or more ropes or wires, wherein the further rope or wire is driven via said one or more further drive units.

22. The apparatus of claim 18, wherein said second associated drive unit is a winch.

23. The apparatus of claim 22, further comprising a further rope or wire, wherein said further rope or wire is deflected by said first associated deflection unit and said third associated deflection unit.

24. The apparatus of claim 19, wherein a position of said first associated deflection device, said second associated deflection device, and said third associated deflection device is adjusted via said first associated drive unit and said second associated drive unit.

* * * * *